US005906063A

United States Patent [19]

Magee, Sr.

[11] Patent Number: 5,906,063

[45] Date of Patent: May 25, 1999

[54] NOVELTY GREETING CARD

[76] Inventor: Orrice Magee, Sr., 14011 Prevost, Detroit, Mich. 48227

[21] Appl. No.: 09/105,439

[22] Filed: Jun. 26, 1998

[51] Int. Cl.[6] ..... G09F 1/00; G09F 11/18

[52] U.S. Cl. ..... 40/124.11; 40/514

[58] Field of Search ..... 40/124.11, 514; 437/368, 405

[56] References Cited

U.S. PATENT DOCUMENTS

| | | | |
|---|---|---|---|
| 678,681 | 7/1901 | Roth | 40/514 X |
| 734,135 | 7/1903 | Porter | 428/30 |
| 3,061,971 | 11/1962 | Fites | 40/124.11 X |
| 3,363,349 | 1/1968 | Nelson | 40/391 |
| 4,299,041 | 11/1981 | Wilson | 40/124.02 |
| 5,032,003 | 7/1991 | Antes | 359/567 |
| 5,117,569 | 6/1992 | Bean | 40/124.11 |
| 5,178,542 | 1/1993 | Chigrinsky et al. | 40/124.11 |
| 5,335,113 | 8/1994 | Jackson et al. | 359/569 |
| 5,390,024 | 2/1995 | Wright | 356/376 |

FOREIGN PATENT DOCUMENTS

| | | | |
|---|---|---|---|
| 504291 | 7/1956 | Italy | 40/514 |
| 2245403 | 1/1992 | United Kingdom | 40/514 |

*Primary Examiner*—Michael F. Trettel
*Assistant Examiner*—Marcus Dolce

[57] ABSTRACT

A new novelty greeting card for providing an amusing illustration therein. The inventive device includes front and back panels pivotally coupled together. The inner side of the back panel has a primary illustration with a plurality of images depicted in a first pose. An animation sheet is positioned on the inner side of the back panel such that the animation sheet covers the primary illustration. One end edge of the animation sheet is coupled to the inner side of the back panel. The animation sheet has a secondary illustration with a plurality of images depicting the images of the primary illustration in a second pose. The other end edge of the animation sheet is coupled to an elongate rod and then rolled about the rod towards the front panel into a cylindrical roll.

7 Claims, 2 Drawing Sheets

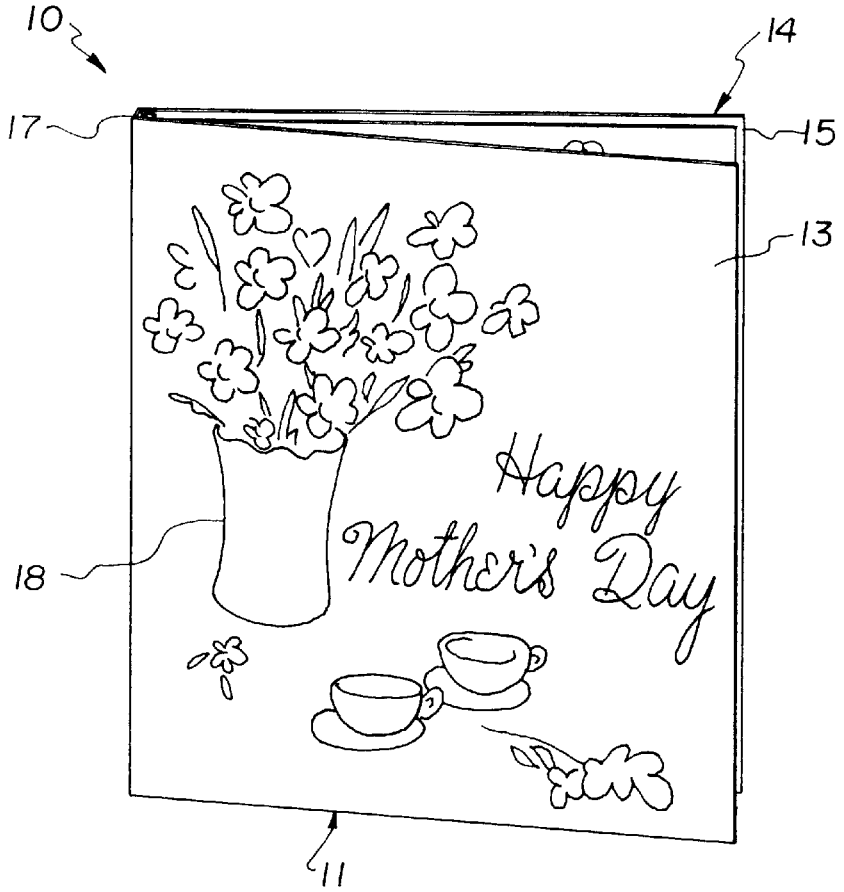
FIG. 1
FIG. 2
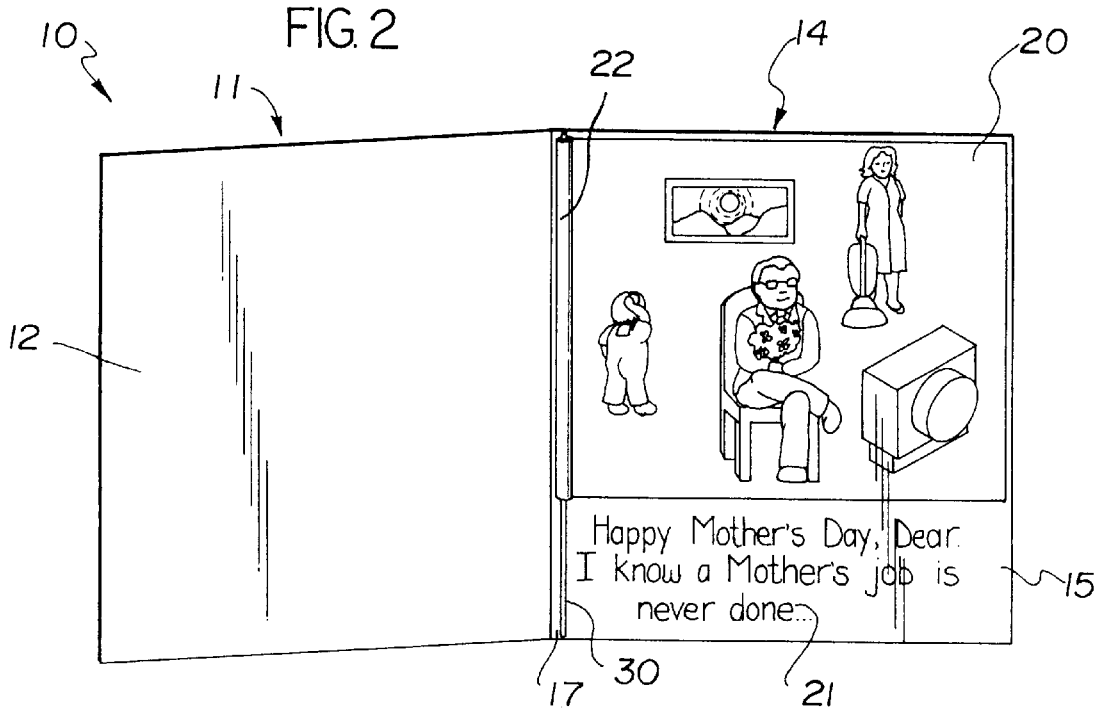

NOVELTY GREETING CARD

BACKGROUND OF THE INVENVENTION

1. Field of the Invention

The present invention relates to greeting cards and more particularly pertains to a new novelty greeting card for providing an amusing illustration therein.

2. Descirption of the Prior Art

The use of greeting cards is known in the prior art. More specifically, greeting cards heretofore devised and utilized are known to consist basically of familiar, expected and obvious structural configurations, notwithstanding the myriad of designs encompassed by the crowded prior art which have been developed for the fulfillment of countless objectives and requirements.

Known prior art greeting cards include U.S. Pat. No. 4,299,041; U.S. Pat. No. 5,335,113; U.S. Pat. No. 5,032,003; U.S. Pat. No. 5,390,024; U.S. Pat. No. 734,135; and U.S. Pat. No. 3,363,349.

While these devices fulfill their respective, particular objectives and requirements, the aforementioned patents do not disclose a new novelty greeting card. The inventive device includes front and back panels pivotally coupled together. The inner side of the back panel has a primary illustration with a plurality of images is depicted in a first pose. An animation sheet is positioned on the inner side of the back panel such that the animation sheet covers the primary illustration. One end edge of the animation sheet is coupled to the inner side of the back panel. The animation sheet has a secondary illustration with a plurality of images depicting the images of the primary illustration in a second pose. The other end edge of the animation sheet is coupled to an elongate rod and then rolled about the rod towards the front panel into a cylindrical roll.

In these respects, the novelty greeting card according to the present invention substantially departs from the conventional concepts and designs of the prior art, and in so doing provides an apparatus primarily developed for the purpose of providing an amusing illustration therein.

SUMMARY OF THE INVENTION

In view of the foregoing disadvantages inherent in the known types of greeting cards now present in the prior art, the present invention provides a new novelty greeting card construction wherein the same can be utilized for providing an amusing illustration therein.

The general purpose of the present invention, which will be described subsequently in greater detail, is to provide a new novelty greeting card apparatus and method which has many of the advantages of the greeting cards mentioned heretofore and many novel features that result in a new novelty greeting card which is not anticipated, rendered obvious, suggested, or even implied by any of the prior art greeting cards, either alone or in any combination thereof.

To attain this, the present invention generally comprises front and back panels pivotally coupled together. The inner side of the back panel has a primary illustration with a plurality of images is depicted in a first pose. An animation sheet is positioned on the inner side of the back panel such that the animation sheet covers the primary illustration. One end edge of the animation sheet is coupled to the inner side of the back panel. The animation sheet has a secondary illustration with a plurality of images depicting the images of the primary illustration in a second pose. The other end edge of the animation sheet is coupled to an elongate rod and then rolled about the rod towards the front panel into a cylindrical roll.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new novelty greeting card apparatus and method which has many of the advantages of the greeting cards mentioned heretofore and many novel features that result in a new novelty greeting card which is not anticipated, rendered obvious, suggested, or even implied by any of the prior art greeting cards, either alone or in any combination thereof.

It is another object of the present invention to provide a new novelty greeting card which may be easily and efficiently manufactured and marketed.

It is a further object of the present invention to provide a new novelty greeting card which is of a durable and reliable construction.

An even further object of the present invention is to provide a new novelty greeting card which is susceptible of a low cost of manufacture with regard to both materials and labor, and which accordingly is then susceptible of low prices of sale to the consuming public, thereby making such novelty greeting card economically available to the buying public.

Still yet another object of the present invention is to provide a new novelty greeting card which provides in the apparatuses and methods of the prior art some of the advantages thereof, while simultaneously overcoming some of the disadvantages normally associated therewith.

Still another object of the present invention is to provide a new novelty greeting card for providing an amusing illustration therein.

Yet another object of the present invention is to provide a new novelty greeting card which includes front and back panels pivotally coupled together. The inner side of the back panel has a primary illustration with a plurality of images is depicted in a first pose. An animation sheet is positioned on the inner side of the back panel such that the animation sheet covers the primary illustration. One end edge of the animation sheet is coupled to the inner side of the back panel. The animation sheet has a secondary illustration with a plurality of images depicting the images of the primary illustration in a second pose. The other end edge of the animation sheet is coupled to an elongate rod and then rolled about the rod towards the front panel into a cylindrical roll.

Still yet another object of the present invention is to provide a new novelty greeting card that has a pair of similar illustrations that creates the appearance of animated images thereon.

Even yet another object of the present invention is to provide a new novelty greeting card that created to serve for a variety of events and needs including, Mother's Day, Father's Day, a Birthday, a Wedding, and a Friendship. The invention may also be used to animate portions of children's books such as in children's pop-up books.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of the outer side of the front panel of a new novelty greeting card in the folded position according to the present invention.

FIG. 2 is a schematic side view of the inner sides of the panels of the present invention in the unfolded position.

DESCRIPTION OF THE PREFERRED EMBODIMENT

Figure 3:
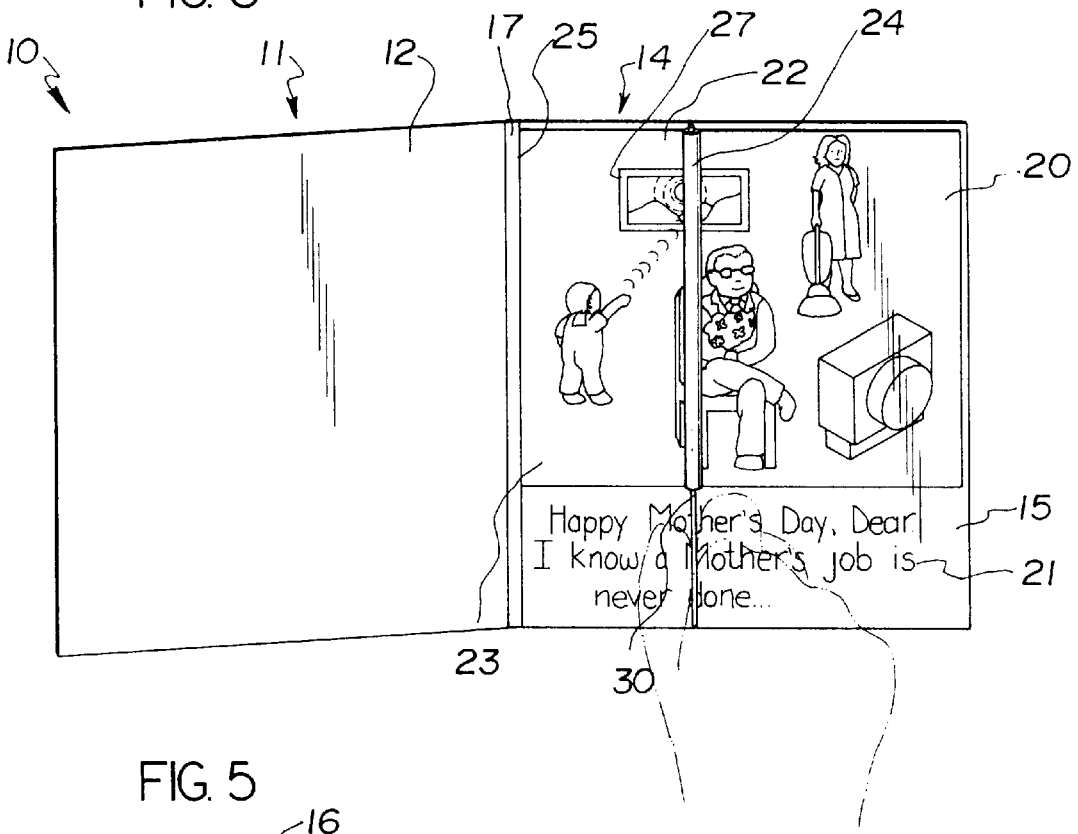
FIG. 3 is a schematic side view of the present invention with the animation sheet being unrolled from the rod over the primary illustration.

With reference now to the drawings, and in particular to FIGS. 1 through 5 thereof, a new novelty greeting card embodying the principles and concepts of the present invention and generally designated by the reference numeral 10 will be described.

As best illustrated in FIGS. 1 through 5, the novelty greeting card 10 generally comprises front and back panels 11,14 pivotally coupled together. The inner side 15 of the back panel 14 has a primary illustration 20 with a plurality of images is depicted in a first pose. An animation sheet 22 is positioned on the inner side 15 of the back panel 14 such that the animation sheet 22 covers the primary illustration 20. One end edge 25 of the animation sheet 22 is coupled to the inner side 15 of the back panel 14. The animation sheet 22 has a secondary illustration 27 with a plurality of images depicting the images of the primary illustration 20 in a second pose. The other end edge 26 of the animation sheet 22 is coupled to an elongate rod 30 and then rolled about the rod 30 towards the front panel 11 into a cylindrical roll.

In closer detail, the front and back panels 11,14 are pivotally coupled together along a fold 17 therebetween. Each of the panels is generally rectangular and has inner and outer sides 12,13,15,16. The panels 11,14 are pivotable between a folded position (FIG. 1)and an unfolded position (FIG. 2). As illustrated in FIG. 1, the inner sides 12,15 of the panels 11,14 generally face each other when the panels are in the folded position while the unfolded position permits viewing of the inner sides 12,15 of the panels 11,14. Preferably, the outer side 13 of the front panel 11 has an introductory cover illustration 18 thereon corresponding to the theme of the greeting card. As illustrated in FIG. 2, the inner side 15 of the back panel 14 has a primary illustration 20 thereon. The primary illustration 20 has a plurality of images depicted in a first pose. When the context of the card requires, the inner side 15 of the back panel 14 may also include a message 21 thereon corresponding to the theme of the greeting card and to the primary illustration 20.

Figure 4:
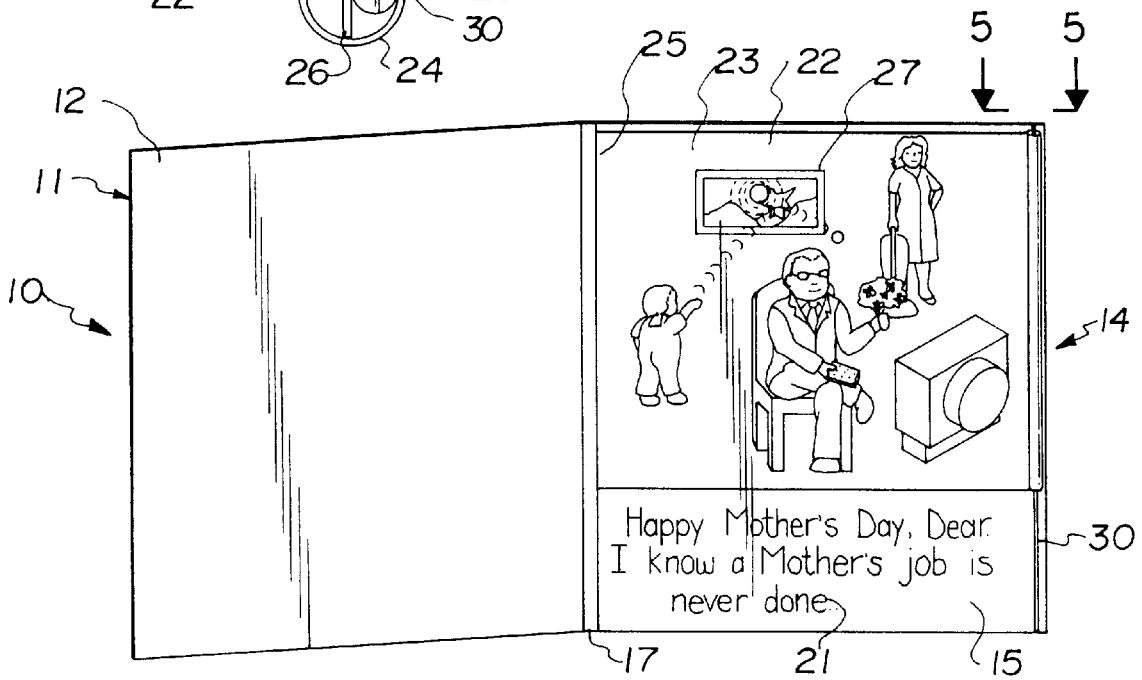
FIG. 4 is a schematic side view of the present invention with the animation sheet unrolled over the primary illustration.

The greeting card 10 also includes an flexible animation sheet 22. The animation sheet 22 is preferably generally rectangular and has an upper 23 and lower 24 sides, and first and second end edges 25,26. As illustrated in FIG. 4, the upper side 23 of the animation sheet 22 has a secondary illustration 27 thereon with a plurality of images depicting the images of the primary illustration 20 in a second pose. The animation sheet 22 is positioned on the inner side 15 of the back panel 14 such that the animation sheet 22 covers the primary illustration 20 with the lower side 24 of the animation sheet 22 facing the inner side 15 of the back panel 14. This way, the upper side 23 of the animation sheet 22 faces away from the inner side 15 of the back panel 14 and facing towards the inner side 12 of the front panel 11 when the front panel 11 is folded over the back panel 14. The first end edge 25 of the animation sheet 22 is coupled to the inner side 15 of the back panel 14. Preferably, the first end edge 25 of the animation sheet 22 is positioned on the inner side 15 of the back panel 14 adjacent the fold 17 between the front panel 11 and the back panel 14.

Figure 5:
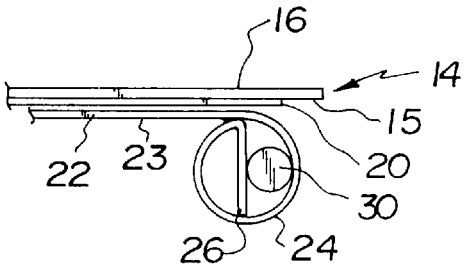
FIG. 5 is a schematic top edge view of the rod and the animation sheet of the present invention as seen from the vantage of line 5—5 of FIG. 4.

The greeting card 10 further includes an elongate cylindrical rod 30 having a pair of opposite ends. As best illustrated in FIG. 5, the second end edge 26 of the animation sheet 22 is coupled to the rod 30. Preferably, the second end edge 26 of the animation sheet 22 is positioned towards one of the ends of the rod 30 so that the other end of the rod can being grasped by as user as illustrated in FIG. 3. With reference to FIGS. 2, 3, and 5, the animation sheet 22 is rolled around the rod 30 into a cylindrical roll such that the upper side 23 of the animation sheet 22 faces inwards in the cylindrical roll towards the rod 30. The animation sheet 22 is rolled about the rod 30 until the rod 30 and the cylindrical roll are positioned adjacent the fold 17 between the front panel 11 and the back panel 14.

With reference to FIGS. 2, 3, and 4, in use, the rod 30 is movable along the inner side 15 of the back panel 14 from the adjacent the fold 17 between the front panel 11 and the back panel 14 towards the edge of the back panel 14 distal the front panel 11 such that the cylindrical roll of the animation sheet 22 is unrolled to cover the primary illustration 20 on the inner side 15 of the back panel 14. The secondary illustration 27 on the animation sheet 22 is revealed as the cylindrical roll of the animation sheet 22 is unrolled such that the images depicted on the primary illustration 20 in the first pose appear to move to the second pose depicted on the images of secondary illustration 27 on the animation sheet 22.

The Figures illustrate an illustrative embodiment of the greeting card 10 for Mother's Day. In this illustrative embodiment, the primary illustration has an image of a child holding a ball, a man holding a bouquet of flowers and a woman holding a vacuum cleaner. In this illustrative embodiment, the secondary illustration on the animation sheet has the images of the child throwing the ball and the man holding the bouquet of flowers out towards the woman. In use, as the animation sheet is unrolled, it appears to a reader that the ball has been thrown by the child and the man's arm has moved.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A greeting card, comprising:

front and back panels being pivotally coupled together, each of said panels having inner and outer sides;

said inner side of said back panel having a primary illustration thereon, said primary illustration having a first plurality of images being depicted in a first pose;

an animation sheet having upper and lower sides, and first and second end edges;

said upper side of said animation sheet having a secondary illustration thereon, said secondary illustration having a second plurality of images depicting said images of said primary illustration in a second pose;

said animation sheet being positioned on said inner side of said back panel such that said animation sheet covers said primary illustration, said lower side of said animation sheet facing said inner side of said back panel;

said first end edge of said animation sheet being coupled to said inner side of said back panel;

an elongate rod having a pair of opposite ends, said second end edge of said animation sheet being coupled to said rod;

said animation sheet being rolled around said rod into a cylindrical roll such that said upper side of said animation sheet faces inwards in said cylindrical roll; and said animation sheet being rollable about said rod until said rod and said cylindrical roll are positioned adjacent said front panel.

2. The greeting card of claim 1, wherein said panels are pivotable between folded and unfolded positions, said inner side of said panels facing each other when said panels are in said folded position.

3. The greeting card of claim 1, wherein said outer side of said front panel has a introductory cover illustration thereon corresponding to, a theme of the greeting card.

4. The greeting card of claim 1, wherein said first end edge of said animation sheet is positioned on said inner side of said back panel adjacent said front panel.

5. The greeting card of claim 1, wherein said second end edge of said animation sheet is positioned towards one of said ends of said rod.

6. The greeting card of claim 1, wherein said rod is movable along said inner side of said back panel from said front panel towards an edge of said back panel distal said front panel such that said cylindrical roll of said animation sheet is unrolled to cover said primary illustration on said inner side of said back panel, said secondary illustration on said animation sheet being revealed as said cylindrical roll of said animation sheet is unrolled such that said images depicted on said primary illustration in said first pose appear to move to said second pose depicted on said second plurality of images of said secondary illustration on said animation sheet.

7. A greeting card, comprising:

front and back panels being pivotally coupled together, each of said panels being generally rectangular and having inner and outer sides;

said panels being pivotable between folded and unfolded positions, said inner side of said panels facing each other when said panels are in said folded position;

said outer side of said front panel having a introductory cover illustration thereon;

said inner side of said back panel having a primary illustration thereon, said primary illustration having a first plurality of images being depicted in a first pose;

an animation sheet being generally rectangular and having upper and lower sides, and first and second end edges;

said upper side of said animation sheet having a secondary illustration thereon, said secondary illustration having a second plurality of images depicting said images of said primary illustration in a second pose;

said animation sheet being positioned on said inner side of said back panel such that said animation sheet covers said primary illustration, said lower side of said animation sheet facing said inner side of said back panel, said upper side of said animation sheet facing away from said inner side of said back panel;

said first end edge of said animation sheet being coupled to said inner side of said back panel, said first end edge of said animation sheet being positioned on said inner side of said back panel adjacent said front panel;

an elongate rod having a pair of opposite ends, said second end edge of said animation sheet being coupled to said rod, said second end edge of said animation sheet being positioned towards one of said ends of said rod, said lower side of said animation sheet facing said inner side of said back panel, said upper side of said animation sheet facing away from said inner side of said back panel;

said animation sheet being rolled around said rod into a cylindrical roll such that said upper side of said animation sheet faces inwards in said cylindrical roll;

said animation sheet being rollable about said rod until said rod and said cylindrical roll are positioned adjacent said front panel; and wherein said rod is movable along said inner side of said back panel from said front panel towards an edge of said back panel distal said front panel such that said cylindrical roll of said animation sheet is unrolled to cover said primary illustration on said inner side of said back panel, said secondary illustration on said animation sheet being revealed as said cylindrical roll of said animation sheet is unrolled such that said images depicted on said primary illustration in said first pose appear to move to said second pose depicted on said second plurality of images of said secondary illustration on said animation sheet.

* * * * *